US006975282B2

(12) United States Patent
Kaufman et al.

(10) Patent No.: US 6,975,282 B2
(45) Date of Patent: Dec. 13, 2005

(54) INTEGRATED SYMMETRICAL REFLECTOR AND BOOM

(75) Inventors: Kenneth A. Kaufman, Palos Verdes Estates, CA (US); Garrett R. Wittkopp, Redondo Beach, CA (US); Kenneth W. Kawahara, Redondo Beach, CA (US); John E. Richer, Carlsbad, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 44 days.

(21) Appl. No.: 10/663,924

(22) Filed: Sep. 16, 2003
(Under 37 CFR 1.47)

(65) Prior Publication Data

US 2005/0057433 A1 Mar. 17, 2005

(51) Int. Cl.[7] ..... H01Q 15/14
(52) U.S. Cl. ..... 343/912; 343/915
(58) Field of Search ..... 343/912, 915, 343/916, 840, 897; H01Q 15/14

(56) References Cited

U.S. PATENT DOCUMENTS 4,201,991 A * 5/1980 Vines ..... 343/840
4,249,184 A * 2/1981 Vines ..... 343/840
6,064,352 A 5/2000 Silverman et al. ..... 343/912

* cited by examiner

*Primary Examiner*—Trinh Vo Dinh
(74) *Attorney, Agent, or Firm*—John A. Miller; Warn, Hoffmann, Miller & LaLone, P.C.

(57) ABSTRACT

An integrated reflector and boom (1) for a deployable space based reflector antenna includes a facesheet (9) of stiff reflective material and a stiff lattice or grid structure bonded to the facesheet in a reflector portion of the assembly and defines a boom to the assembly. The grid structure is formed of ribs (13, 15, 17 & 19) that interlock through slots formed in the ribs, arranged in a symmetric pattern that defines an isogrid structure in the reflector portion and in at least a part of the boom assembly. At least some of the ribs extend in one piece from the reflector portion and into the boom. One of those ribs (13) is located along an axis of symmetry of the grid structure.

17 Claims, 3 Drawing Sheets

INTEGRATED SYMMETRICAL REFLECTOR AND BOOM

BACKGROUND OF THE INVENTION

1. Field of the Invention

The present invention relates to deployable satellite antennas and, more particularly, to the boom structure that deploys, aligns and accurately holds the parabolic reflector (and/or subreflector) of the antenna to a satellite or another antenna element, and to ensuring accuracy of boom-to-reflector alignment on deployment of the antenna.

2. Discussion of the Related Art

One type of directional antenna commonly used in space based communications is the parabolic antenna. That antenna comprises a parabolic reflector and a microwave feed positioned at the focal point of the antenna. Another type of directional antenna that has achieved wide acceptance in the foregoing application is the dual reflector or Cassegrain antenna, which contains two reflectors, a parabolic reflector and a hyperbolic sub-reflector, the reflecting surfaces of which may be either concave or convex in shape.

Space based communications links typically require directional antennas that are deployable. The antenna construction and associated supports are articulated and fold-up for stowage in or on the satellite for transport into orbit. Once the satellite attains the correct orbit, the antenna is unfolded on command from a compact stowed condition and is deployed for operation, establishing a communication link.

To accomplish that a deployable antenna includes a boom (or booms), an arm that carries the reflector (or reflectors) from the stowed position on a satellite to the deployed position, setting up the antenna, and holds the reflector in that position thereafter. In the case of a space based deployable dual reflector antenna each of parabolic and hyperbolic reflectors is attached to a respective boom which positions and supports those reflectors in respective deployed positions. In a reflector antenna, the boom is carefully aligned and bolted to the reflector; and in the dual reflector antenna each reflector is carefully aligned and bolted to the respective reflector.

Many spacecraft applications require rigid, low-weight, and thermally stable components. Specifically, current spacecraft antenna applications require high precision reflector contours (RMS 0.001 to 0.002 inch) in addition to low thermal distortion and therefore, feature a variety of very complex configurations requiring lightweight, thermally stable composite materials. Bolting two parts together in such a precision assembly is problematic. The bolts must be torqued with care to the proper tightness to ensure that the two pieces cannot become detached during the ride into space or thereafter in the wide range of temperature extremes encountered in space, a range of about ±250 degrees Fahrenheit.

In torquing the attaching bolts it is possible to distort the surface of the reflector, and force the surface to depart from the high precision required, either initially or later when the antenna is deployed in space and encounters the known range of temperatures in that environment. Of necessity the bolts may be of a different material than the boom and possess a different characteristic of thermal expansion (and contraction). When exposed to a temperature extreme, because of the different thermal characteristics the bolts could become over-torqued and physically distort the reflector.

Anticipating the foregoing potential problem with prior antennas, typically, preflight checks are made of distortion. The entire antenna, including the boom or booms, are placed in a thermal chamber and checked for distortion over the anticipated thermal range of operation in space, although remaining subject to the effect of gravity. If the antenna fails the test, the entire antenna construction may need to be repeated. As is appreciated, the foregoing is a time consuming and expensive process necessitated by the inability or great difficulty and greater expense to send a repair crew into space to repair or replace a defective antenna.

As newer antennas have become larger and larger in size it becomes necessary to build larger and larger thermal chambers to implement a thermal test, which adds to the expense of developing an antenna. Alternatively one must forego thermal testing and bear the attendant risks if neither manufacturer nor customer wishes to bear the expense of thermal testing. The foregoing poses a problem to the manufacturer and customer who would each prefer to avoid the cost and risk.

As an advantage, the present invention avoids both the foregoing cost and risk by eliminating the bolts, the bolting, the testing, and the risk of thermally induced physical distortion of the reflector by eliminating attaching devices of materials that have thermal characteristics that differ significantly from that of the reflector.

A recent innovation in the construction of parabolic and hyperbolic reflectors is the composite isogrid reflector structure presented in U.S. Pat. No. 6,064,352 to Silverman et al (the '352 patent), granted May 16, 2000 and assigned to TRW Inc., the assignee of the present invention. The reflector construction of the '352 patent provides a reflector of high stiffness and lightweight, which are very desirable properties for space based antennas. Employing integral reinforced interlocked parabolically curved ribs connected in triangular isogrid patterns, a parabolic profile is defined collectively by the edges of the ribs on a side of the grid (or in the case of a sub-reflector a hyperbolically profile is defined collectively by the edges of the grid). The foregoing grid is permanently bonded to a thin curved reflective sheet, referred to as the facesheet, that serves as the (or hyperbolic) reflecting surface of the reflector. The isogrid structure adds strength and stiffness to the facesheet. The present invention takes advantage of the foregoing innovation and, accordingly, the applicants refer to and incorporate here within the content of the '352 patent.

Accordingly, a principal object of the present invention is to improve the design of deployable high precision parabolic antennas.

A further object of the invention is to minimize the occurrence of surface distortion in the reflectors of space based deployable antennas as a result of wide swings of temperature.

An additional object of the invention is to eliminate materials that possess significantly different thermal characteristics than the reflector of a space based deployable antenna from the boom to reflector attachment interface.

A still additional object of the invention is to eliminate any necessity for bolts to attach a deployable reflector to a boom in a deployable antenna.

A still further object of the invention is to reduce the cost of developing deployable high precision reflector antennas for space based application.

And an ancillary object of the invention is to provide a new design for a space based deployable dual reflector antenna.

SUMMARY OF THE INVENTION

In accordance with the foregoing objects and advantages, an integrated reflector and boom for a deployable space based reflector antenna in accordance with the invention includes a facesheet of stiff reflective material and a stiff lattice or grid structure bonded to the facesheet in a reflector portion of the assembly and defines a boom to the assembly. The grid structure is formed of ribs that interlock through slots formed in the ribs, arranged in a symmetric pattern that defines an isogrid structure in the reflector portion and in at least a part of the boom assembly. At least some of the ribs, including a central rib whose axis defines an axis of symmetry to the grid structure, extend in one piece from the reflector portion and into the boom.

The foregoing and additional objects and advantages of the invention, together with the structure characteristic thereof, where were only briefly summarized in the foregoing passages, will become more apparent to those skilled in the art upon reading the detailed description of a preferred embodiment of the invention, which follows in this specification, taken together with the illustrations thereof presented in the accompanying drawings.

DETAILED DESCRIPTION OF THE EMBODIMENTS

Figure 1:
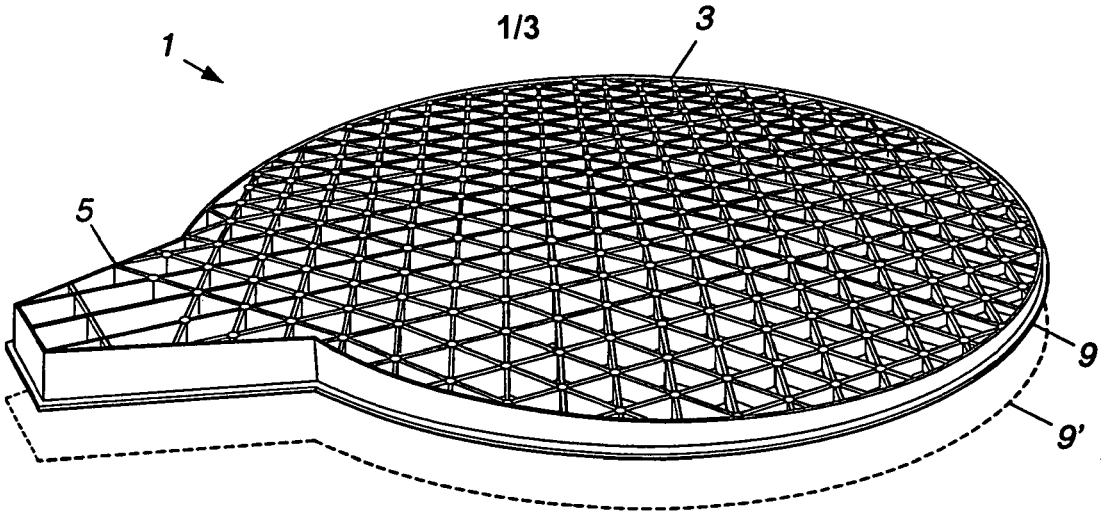
FIG. 1 is a perspective of the integral reflector boom.
Figure 2:
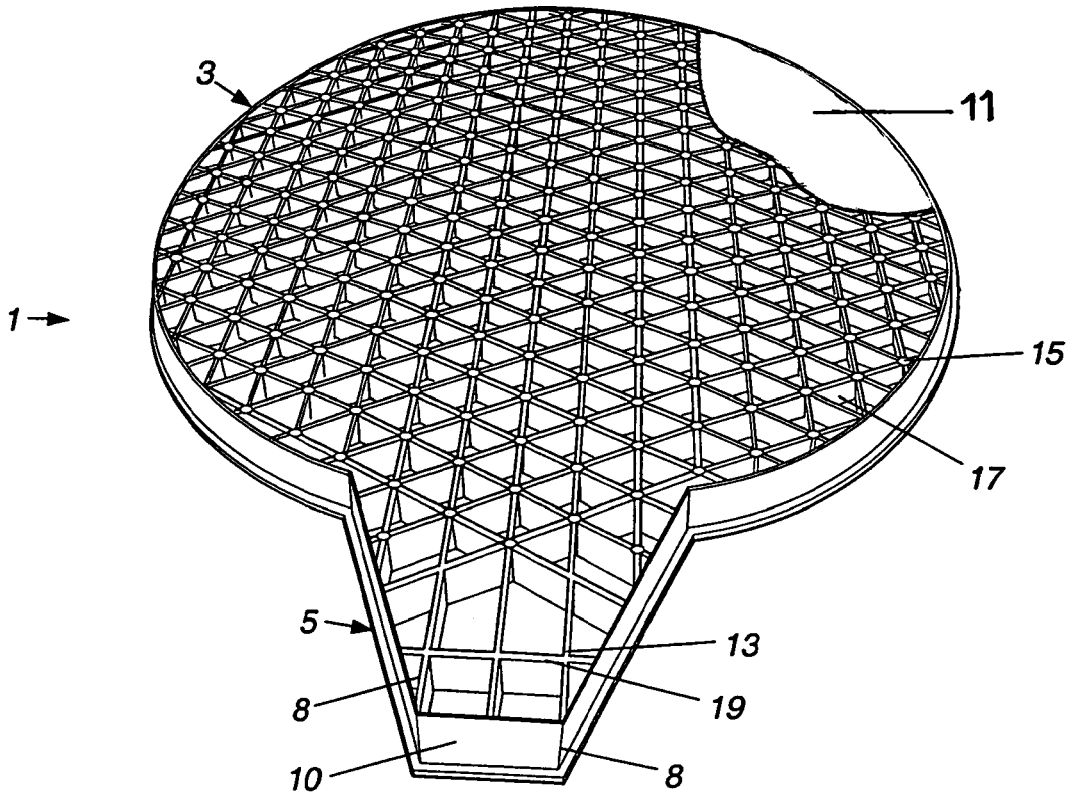
FIG. 2 is another illustration of the integral reflector boom of FIG. 1 as viewed from another angle.

Reference is made to FIGS. 1 and 2 illustrating an embodiment of the antenna reflector and boom combination 1 from the back side in perspective from two different orientations. Resembling a "paddle", the integrated one-piece assembly contains both a parabolic isogrid reflector 3, a section of the structure, which includes the reflecting surface 9, herein referred to as the reflector section; and a boom 5, the paddle "handle", in a second section of that structure of smaller area, sometimes herein referred to as the boom section, which may also include an isogrid structure. The reflector section is elliptical in outline and the boom section outline is a truncated triangle in geometry.

Boom 5 carries and holds the reflector. The distal end of the boom is adapted for connection to a bracket, not illustrated, that grips and holds the end of the boom when the reflector is to fixed in place in the antenna. More typically, the boom is gripped and held to a portion of a hinge, later herein described, to permit the reflector be swung or pivoted from a stowed position to a fully deployed position.

The reflector 3 and boom 5 are presented from the rear or backside in the figure to exposes a reinforcing lattice, grating or grid, as variously termed, to view. The grid is formed by a large number of upstanding interlocked stiff slats or ribs 13, 15, 17 and 19 of short height. The thin straight lines visible in the figures are the rear edges of those ribs and side wall portions of many of those ribs are visible in the perspective views of FIGS. 1 and 2. The ribs provide a stiff structure over the principal area of the two sections of the reflector boom assembly, forming a large number of contiguous triangular shaped sections, the isogrid. Most of those triangular shaped sections form isosceles triangles.

For this description the ribs are divided into a number of different groups, depending upon the direction in the figure. Those ribs that extend in one-piece straight across from the rear of the boom section through the reflector section to the front are labeled 13. Those ribs that extend in one piece at an angle, suitably sixty degrees, to ribs 13 to the upper right in FIG. 2 are labeled 15. Those ribs that extend in one piece at a like angle to ribs 13, but to the upper left in FIG. 2 are labeled 17.

The foregoing intersecting ribs form the triangles illustrated. In the embodiment, three of ribs 13 extend in one piece from the distal end through the boom and across the reflector section; and three each of ribs 15 and 17 extend in one piece through the reflector section and into the boom section. The center rib in the group of ribs 13 is aligned with the longitudinal axis of the foregoing assembly.

An additional type of rib, referred to as a bracing rib, is denominated as 19. The latter rib extends across the width of the boom perpendicular to the longitudinal axis of the boom, and perpendicular to the three ribs 13 in the boom region. Bracing rib 19 interlocks with and braces ribs 13 at or proximate the distal end of boom 5. The foregoing rib structure thereby unites both sections into the integrated assembly and provides a sturdy boom.

Each rib contains slots to interlock with another rib, such as was described in the '352 patent, much like the familiar cardboard compartment dividers used to compartmentalize a cardboard box. At each intersection of two or three ribs the respective ribs include a slot. As example, reference is made to FIG. 3 that shows a portion of the boom section in exploded view. Each of the spaced ribs 13 contains a slot to interlock through a corresponding slot in bracing rib 19, which contains three slots, one for each intersecting rib. All intersections of those ribs are bonded with an adhesive epoxy or the like to ensure permanence and prevent the ribs from detaching.

Returning to FIGS. 1 and 2, the front surface or face of the grid, not visible in the figure, more particularly the front edge of the ribs collectively, defines a three-dimensional concave parabolic surface over the reflector section and a flat surface over the boom section. The front edges of the portions of ribs 13, 15 and 17 that are positioned over the reflector section 3 are profiled in shape to collectively define a three-dimensional curved surface, appropriately, a concave parabolic surface, such as described in the '352 patent.

Figure 4:
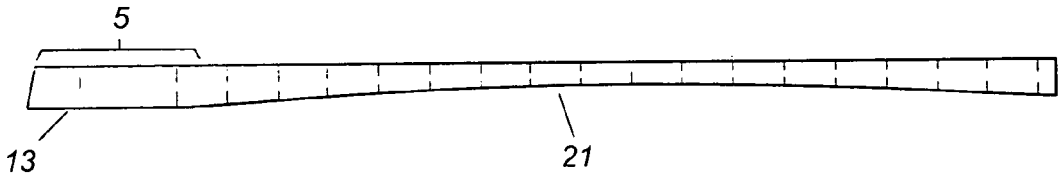
FIG. 4 illustrates one of the longest ribs used in the embodiment of FIG. 1 in side view.

As example, the central one of the ribs 13 is illustrated in side view in FIG. 4. The foregoing rib extends in one piece through both the reflector and boom sections of the rib. The portion of the front edge of the foregoing rib that is positioned in the reflector section is profiled in a shallow concave parabolic shape 21. The front edge of the portion of the foregoing rib positioned in the boom section 5, is straight and defines a flat surface. Likewise the portions of the front edges of the other ribs that are located in the boom section 5 are also straight and flat. As those skilled in the art appreciate in other embodiments the profiling of the rib edges in the reflector section may be of a convex parabolic shape, or either a convex or concave hyperbolic shape, or any other curved surface that an antenna designer might chose to select.

Returning again to FIGS. 1 and 2, the curved reflective surface 9 in the form of a skin facesheet mates with and attaches to the front edges of the ribs located in the reflector section 3 of the grid. The skin facesheet is slightly larger in area than the formed grid and overlaps the sides of the grid, forming a rim visible from the back side in the figure that extends about most of the periphery of the assembly. Skin facesheet 9 is a continuous surface of a stiff material, preferably molded to shape, that is bonded to and covers at least the parabolic face of the reflector section of the grid and the flat face of the boom section.

A preferred material for the facesheet is a graphite composite material. The facesheet is formed into a generally parabolic shape, suitably by molding, to mate with the parabolic profile of the reflector section of the grid (or vice-versa) and is suitable for bonding to the grid with an adhesive, such as epoxy. The facesheet material also reflects microwave energy. The facesheet is preferably stiff and self-supporting to a degree, but not sufficient in stiffness to withstand the forces of handling and space travel and without distortion in shape. The reinforcing grid adds greater rigidity and stiffness to the facesheet and, as combined, is of practical application in an antenna for space application.

To aid in visualizing the foregoing, facesheet 9 is also shown in FIG. 1 in a partially exploded view 9' in dotted lines on the underside of the integrated reflector and boom assembly 3 and 5. Although the skin facesheet is described as a single piece of material, as those skilled in the art appreciate, in alternative less preferred embodiments the face sheet may be fabricated in two sections, one for each of the reflector section and boom section, and be attached separately to the framework.

Referring to FIG. 2, thin strips of sheet material 8 form sidewalls to the boom 5 and another strip 10 serves as a rear wall to the boom. The foregoing strips are formed of the same material as the ribs and facesheet and are bonded to the side edges of the ribs 13, 15 and 17 that border the respective sides and ends. The foregoing side and end walls add further rigidity to the boom section of the assembly.

If additional stiffness is desired in the foregoing, an optional stiff flanged skin backsheet or covering backsheet such as described and illustrated in the '352 patent, is preferably added to the back or rear side of the grid reflector and bonded thereto, such as described in the '352 patent. Preferably the backsheet is formed of the same material as the reflective surface, such as a graphite composite.

A flanged backsheet contains less material than a cover sheet that covers the entire area. Hence, the resultant assembly will be of less weight. In the flanged backsheet, the pattern is the same as that formed by the ribs, but the tines or lines of the backsheet are slightly wider than the edge of the ribs to form effective "I-beam" like cross-sections with the ribs when bonded as well as to reduce the size of the various triangular "windows" formed in the grid. The foregoing provides the same mechanical resistance to bending and twisting of the rib as is inherent in an I-beam. The flanged backsheet provides structural continuity over the slots at the rib intersections and reinforces the ribs against buckling while reducing the overall thickness of the reflector and, provides additional structural reinforcement to the reflector while not contributing significantly to the overall weight of the parabolic reflector.

A flanged backsheet is preferably included in practical embodiments of the foregoing integrated boom and reflector. A portion of a flanged backsheet 11 of the type described herein is shown in FIG. 2 and is cut-away to expose the isogrid structure.

Figure 5:
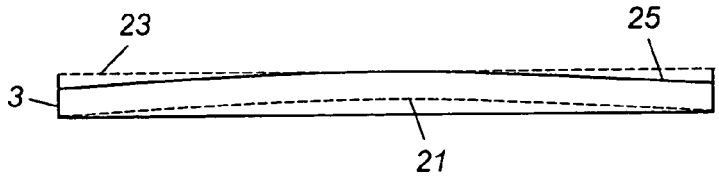
FIG. 5 is a pictorial of an end view of the embodiment of FIG. 1 as viewed from the end of the reflector section.

It is further noted that the rib construction is not restricted to ribs with constant depth. Ribs which taper in depth from the center to the edge of the reflector can be implemented by fabricating the skin backsheet 24 on a second mold with a different parabolic focal length than that of the skin facesheet 9. Similarly, the reflector design can be used on offset reflectors, with either constant depth or tapered ribs. FIG. 5 is a pictorial view, not to scale, of the assembly of FIG. 1 as that assembly is viewed from the end of the reflector 3. The parabolic surface of the front face of the grid is represented by dash line 21. Should the rear face of the assembly be flat as when the ribs are constant in maximum height, the configuration would be as indicated by dotted line.

However, to reduce weight the right and left hand sides to the reflector are chamfered. That is, they taper from a position near the center of the rear face of the grid to the right and left hand extremities so that the outline is as represented by line 25. Returning to FIG. 2 that taper may be a constant slope beginning along the line or rib 13 located at the juncture between the boom section and the reflector section on the right hand side and extending through the reflector section. From that line the taper extends downwardly to the right. A like taper is formed on the left hand side. It should be realized that the foregoing tapers illustrated in FIG. 5 are exaggerated, and are not readily discernable in FIGS. 1 and 2. Accordingly the depth or height of the ribs in the tapered section will gradually decrease linearly as the position is closer to the right or left hand sides of the reflector 3 as viewed in FIG. 5.

In one practical embodiment of the foregoing embodiment, the ribs, the facesheet and the backsheet are formed of the same graphite composite material. The major and minor axes of the reflector section were approximately 77.6 inches and 69.0 inches in length respectively and covered an area of approximately 4,216 square inches. The boom section was approximately 16.4 inches in length, and at its widest was 22.5 inches and at the distal end was 8.0 inches in width. The assembly was of an overall length of approximately 94.0 inches. The basic rib thickness was 0.020 inches. The three center ribs had doublers, in the area of the boom extension, which increased their thickness to 0.080 inches. The facesheet was 0.020 inches thick. The back sheet was in three sections. The center section had a thickness of 0.040 inches while the two sections to either side had a thickness of 0.020 inches. Ribs 15 and 17 numbered eighteen ribs each and ribs 13 numbered seventeen. In another practical embodiment, thin panels, not illustrated, were bonded to the side of the central ribs over portions of the length of the rib that extended into the boom portion of the integrated assembly for added stiffening. Those thin panels were of the same material as the ribs and in thickness of 0.020 inches.

The curved reflector of FIGS. 1 and 2 is a parabolic reflector in which the three dimensional figure defined by a face of the framework (and the skin facesheet) defined a parabolic surface that was essentially concave in nature relative to the outer perimeter of the reflector section. As one appreciates the foregoing description is equally applicable to the construction of a hyperbolic reflector in which the framework (and skin facesheet) describe a concave hyperbolic shape relative to the outer perimeter of the reflector section of the reflector boom assembly. To fabricate the hyperbolic reflector, one only need to vary the height of the ribs (or portions thereof that are positioned in the reflector region of the structure and mold the skin facesheet in a hyperbolic shape to mate with the figure defined by the face of the framework.

Figure 6:
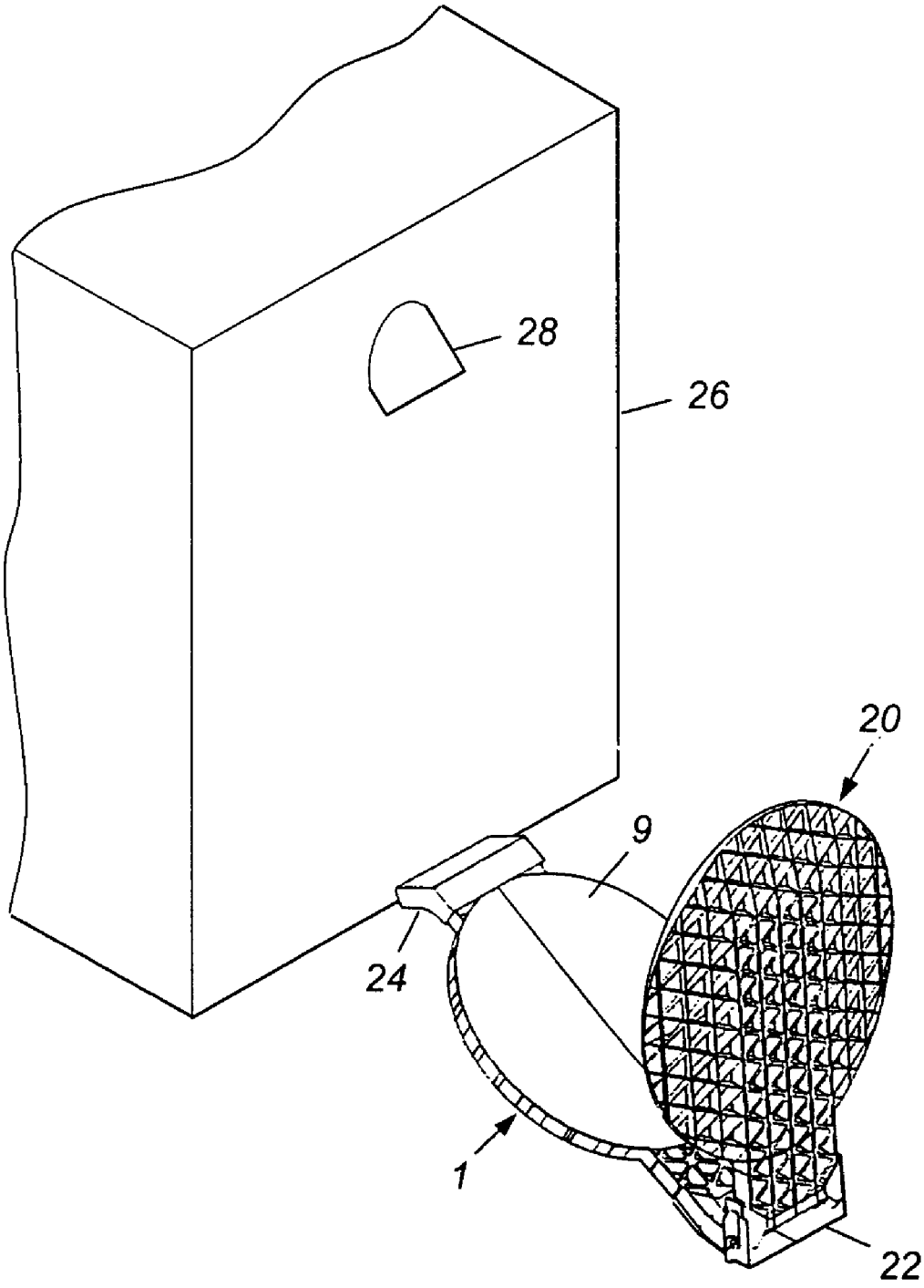
FIG. 6 is a perspective view of a deployable dual reflector antenna that incorporates the embodiment of FIG. 1.

With both a hyperbolic reflector and boom assembly and a parabolic reflector and boom assembly being possible of construction, the two may be combined and hinged together to construct a deployable dual reflector antenna, such as is illustrated in FIG. 6.

A dual reflector antenna constructed in accordance with the invention includes the integrated parabolic reflector and boom 1, earlier described in connection with FIGS. 1 and 2 and an integrated hyperbolic reflector and boom 20, illustrated in a deployed position in the figure. The two assemblies are pivotally connected together by a hinge 22 at the distal end of the two booms and in appearance resemble the familiar household "waffle iron". The hinge contains a built in angle stop that limits the relative angular rotation of the two reflectors to the angle set by the antenna designer. A spring, electric motor or other type of actuator is incorporated within or associated with the hinge to pivot the hinge sections about the hinge axis.

A connector 24 attached to the remote end of the reflector section of the reflector 1 connects the dual reflector antenna to the satellite or to a container 26 of a communications package carried by the satellite. The connector is also pivotal connector containing a pivot stop, not illustrated, and may also be spring-loaded by a spring.

Prior to deployment the hyperbolic reflector assembly 20 is pivoted against the parabolic reflector assembly 1, much like a closed waffle iron, and the entire assembly is rotated about connector 24 against or near and in parallel to the side wall of container 26, at which position the deployable antenna is held in place by a releasable remotely controlled latch or release mechanism, not illustrated. When the dual reflector antenna is to be deployed, the release mechanism is released and the assembly pivots clockwise in the figure, motivated by the spring (or alternative actuator). As the dual reflector assembly pivots, hyperbolic reflector 20 also pivots clockwise relative to the parabolic reflector about the hinge axis motivated by the particular actuator associated therewith, spring, electric motor or other type of actuator. Both antenna reflectors, thus, unfold. At a predetermined angular position, the rotation about the pivot axis of connector 24 is halted by the connector stop. Likewise, at a predetermined angular position relative to the parabolic reflector 1, the angular rotation of the hyperbolic reflector 20 is halted by the hinge stop.

The antenna feed 28 is located in the side wall of housing 26. When the antenna is deployed as shown in the figure the two reflectors are properly positioned relative to one another and relative to feed 28 for proper operation.

Individual triangular shaped sections of the grid each have a moment of inertia to bending characteristic (i.e. resistance to twisting/bending) and the stiffness of the grid is the aggregate resistance to twist of its individual triangular members. Therefore, a high resistance to bending of the individual triangular members provides a high resistance to bending of the entire grid structure framework. In the foregoing embodiment the triangle shaped sections defining the isogrid portions of the grid are included throughout the reflector section. Only a few such triangular sections are included in the boom section of the assembly. The boom section contains box shaped and trapezoidal shaped sections as well. It should be realized that in alternative embodiments additional triangular shaped sections may be included in the boom section and/or the boom section may be constructed entirely of ribs that define triangle shaped sections.

The foregoing embodiments of the integrated reflector and boom of FIGS. 1 and 2 describe the isogrid as profiling or defining concavely profiled parabolic and hyperbolic surfaces. As those skilled in the art appreciate the isogrid (and the profiling of the ribs) in other embodiments may instead profile or define a convex shaped surface or any other type of curved surface desired by the designer of a reflector system, some of which may be presently unknown, and all of which fall within the scope of the present invention. In still other embodiments the isogrid may define a flat surface. As recognized by those skilled in the art, in some applications at very very high frequencies, a flat reflective surface may be needed to function like a mirror.

In the foregoing embodiments the rib spacing is essentially even. In other embodiments the spacing need not be even. As example, the central region of the grid structure may contain ribs that are more closely spaced together and with greater spacing (and fewer ribs) at the edges of the structure. In still other embodiments the spacing between ribs may vary with the distance from the center rib, a spacing that continuously varies. The foregoing arrangements provide greater mechanical strength in the central area, where the strength may be needed, and less strength in the outer regions of the antenna structure.

Additionally, the ribs in the foregoing embodiment are all of the same thickness. In alternative embodiments, it may be desired to have some of the ribs be greater in thickness than other ribs in the structure. As example, the straight center rib along the axis of the assembly could be made more thick or the foregoing center rib and the ribs on either side of the center rib could be made of sheet material that is more thick than the sheet material from which the other ribs of the grid structure are cut. In any such arrangement, the thicker ribs should preferably be distributed equally about the central axis of the assembly.

Figure 3:
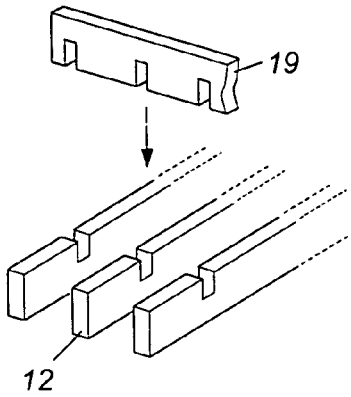
FIG. 3 is shows slotted ribs in a partially exploded view of a portion of the integral reflector boom.

In the foregoing embodiment, the ribs are arranged symmetrically about a center rib 13 (FIG. 3). As one appreciates in other embodiments for applications in which less precision is required, the center rib may be omitted. In still other embodiments for applications in which even less precision is required, the ribs may be arranged asymmetrically.

The foregoing embodiment employed an isogrid structure that extended over a major portion of the reflector portion of the combination. Other geometrical configurations formed by the ribs may be substituted for the isogrid, as example, an orthogrid structure. Because the orthogrid structure produces square shaped grids, the resultant grid structure is less rigid than a comparable isogrid arrangement of the same rib thickness. Hence to increase the rigidity of the orthogrid, the ribs of the orthogrid would be made more thick than those of the isogrid. However, doing so increases the weight of the resultant orthogrid structure. For space based application, the weight of the antenna and boom structure should be kept to a minimum. For that reason, the orthogrid structure is less preferred.

Graphite (carbon) composite was used as the preferred construction material for the foregoing embodiments. Other comparable materials may of course be substituted without departing from the scope of the present invention. As example, Kevlar® composite material may be substituted where desired for the facesheet and/or backsheet and/or the ribs in the foregoing embodiments.

The foregoing embodiment of the invention is intended for a space based application. As is recognized, the invention is not restricted to such an application, and, accordingly, may be employed in a ground based application, should one desire to do so. In as much as weight becomes a factor in ground based applications, the materials selected would be such as to provide the appropriate stiffness to prevent any sagging.

It is believed that the foregoing description of the preferred embodiments of the invention is sufficient in detail to enable one skilled in the art to make and use the invention without undue experimentation. However, it is expressly understood that the detail of the elements comprising the embodiment presented for the foregoing purpose is not intended to limit the scope of the invention in any way, in as much as equivalents to those elements and other modifications thereof, all of which come within the scope of the invention, will become apparent to those skilled in the art upon reading this specification. Thus, the invention is to be broadly construed within the full scope of the appended claims.

What is claimed is:

1. An integrated reflector and boom assembly, comprising:

a facesheet of stiff reflecting material defining a curved reflecting surface;

a series of stiff interlocking ribs defining a reflector section and a boom section, with said boom section being contiguous to said reflector section and covering a smaller area than said reflector section, said series of ribs being interlocked to form a single stiff grid having an axis of symmetry extending through both said reflector section and said boom section;

said interlocking ribs further comprising:

a first plurality of straight ribs oriented in a first direction, said ribs of said first plurality being evenly spaced and in parallel;

said first plurality of straight ribs including;

a first rib in alignment with said axis of symmetry and extending in one piece through both said reflector section and said boom section and second and third ribs positioned on opposite sides of said first rib, each of said second and third ribs respectively extending in one piece through both said reflector section and said boom section;

a second and third plurality of ribs, said second and third plurality of ribs being equal in number;

said plurality of ribs in said second plurality being evenly spaced and in parallel and said plurality of ribs in said third plurality being evenly spaced and in parallel;

said second plurality of ribs being oriented at a first predetermined angle relative to said first rib of said first plurality of ribs; and said third plurality of ribs being oriented at a second predetermined angle relative to said first rib of said first plurality of ribs, said second predetermined angle being equal to said first predetermined angle and opposite in direction thereto;

an additional straight rib positioned in said boom section, said additional straight rib being oriented at right angles to and interlocked to each of said first, second and third ribs of said first plurality of straight ribs;

said second and third plurality of straight ribs extending through said reflector section with a minority of straight ribs in each of said second and third plurality of straight ribs also extending into said boom section; and said facesheet being bonded to an edge of said first, second and third plurality of ribs located in a front face of said grid within said reflector section.

2. The integrated reflector and boom assembly as defined in claim 1, wherein said first and second predetermined angles comprise sixty degrees.

3. The integrated reflector and boom assembly as defined in claim 1, wherein first, second and third plurality of ribs define an array of triangles of equal size.

4. The integrated reflector and boom assembly as defined in claim 1, wherein a majority of said triangles comprises isosceles triangles.

5. The integrated reflector and boom assembly as defined in claim 1, wherein said facesheet further defines a flat section and wherein said flat section of said facesheet is bonded to those of said first, second and third plurality of ribs in and underlying a front face of said boom section and to said additional rib.

6. The integrated reflector and boom assembly as defined in claim 5, wherein said plurality of said first plurality of ribs, comprises seventeen and wherein said plurality of each of said first and second plurality of ribs, comprises eighteen.

7. The integrated reflector and boom assembly as defined in claim 1, wherein said material of each of said facesheet and said ribs comprises a graphite composite.

8. The integrated reflector and boom assembly as defined in claim 1, further comprising: a backsheet of stiff sheet material, said backsheet being bonded to another edge of said first, second and third plurality of ribs located in a rear face of said grid within both said reflector and boom sections.

9. The parabolic reflector as recited in claim 8, wherein said backsheet is formed from a graphite composite material.

10. The parabolic reflector as recited in claim 9, wherein said backsheet is a flange backsheet.

11. An integrated reflector and boom assembly, comprising:

a surface of stiff reflective sheet material;

a stiff grid having a first region for supporting said surface and a second region defining a boom, said second region being contiguous with said first region at an outer edge of the first region, said grid having an axis of symmetry;

each of said first and second regions including a front face and a rear face, said front face of said first region being larger in area than said front face of said second region and having a profile to mate with said surface;

said surface being bonded to at least said front face of said first region;

said stiff grid further comprising a plurality of ribs and wherein at least some of said ribs extend in parallel in one piece from said first region into said second region and are positioned symmetrical to said axis of symmetry.

12. The integrated reflector and boom assembly as defined in claim 11, wherein said plurality of ribs further includes:

a straight rib extending in one piece along said axis of symmetry from said first region into said second region.

13. An integrated reflector and boom assembly comprising:

an interlocking grid structure including a plurality of interlocking ribs, said grid structure including a reflector portion and a boom portion that are contiguous with each other where the boom portion is provided at an outer edge of the reflector portion, wherein the ribs include a plurality of straight ribs that extend through the reflector portion and the boom portion and a plurality of angled ribs that extend through the reflector portion, and wherein the angled ribs and the straight ribs in the reflector portion define triangular areas; and a reflective sheet formed over the grid structure.

14. The integrated reflector and boom assembly according to claim 13 wherein the triangular areas are equal in size.

15. The integrated reflector and boom assembly according to claim 13 wherein most of the triangular areas are isosceles triangular areas.

16. The integrated reflector and boom assembly according to claim 13 further comprising a backsheet of a stiff material mounted to the grid structure opposite to the reflective sheet.

17. The integrated reflector and boom assembly according to claim 13 wherein the ribs are made of a graphite composite.

* * * * *